United States Patent [19]

Greiser

[11] 4,012,744

[45] Mar. 15, 1977

[54] HELIX-LOADED SPIRAL ANTENNA

[75] Inventor: John W. Greiser, Marina Del Rey, Calif.

[73] Assignee: Itek Corporation, Lexington, Mass.

[22] Filed: Oct. 20, 1975

[21] Appl. No.: 624,040

[52] U.S. Cl. ..... 343/895

[51] Int. Cl.[2] ..... H01Q 1/36

[58] Field of Search ..... 343/895

[56] References Cited

UNITED STATES PATENTS

| | | | |
|---|---|---|---|
| 3,241,148 | 3/1966 | Lechtreck | 343/895 |
| 3,441,937 | 4/1969 | Clasby et al. | 343/895 |
| 3,787,871 | 1/1974 | Reese | 343/895 |
| 3,820,117 | 6/1974 | Hall et al. | 343/895 |
| 3,825,933 | 7/1974 | Debski | 343/895 |

OTHER PUBLICATIONS

"String Transmission and Helical Wave Coils" by Freedman, Radio–Electronics, June 1951, pp. 25, 26.

*Primary Examiner*—Harold A. Dixon

*Attorney, Agent, or Firm*—Homer O. Blair; Robert L. Nathans; Gerald H. Glanzman

[57] ABSTRACT

A circularly polarized, broad-beamed antenna system capable of effectively covering the entire bandwidth of from about 0.5 GHz to about 18 GHz or higher. The system provided comprises a generally conventional planar spiral antenna modified by having the outer ends of its arms terminated by a bifilar helix. The bifilar helix is positioned behind the planar spiral and at 90° to it. By proper coupling of the two antenna portions, it has been found that within the 2 to 18 GHz range, the planar spiral operates as if the helix were not present, while below 2 GHz, the spiral functions as a transmission line feeding the helix and the helix radiates essentially all of the energy from the antenna.

The antenna system provided is approximately the same size as conventional 2 to 18 GHz cavity backed spiral antennas and generally satisfies all of the physical constraints and limitations placed upon airborne radar-warning systems.

12 Claims, 4 Drawing Figures

HELIX-LOADED SPIRAL ANTENNA

BACKGROUND OF THE INVENTION

1. Field of the Invention

The present invention relates generally to a novel antenna system for airborne radar warning systems and other applications. More particularly, the present invention relates to a spiral-helix antenna having an expanded bandwidth covering from about 0.5 GHz to about 18 GHz.

2. Description of the Prior Art

Over the years electronic warfare equipment in general and radar warning systems in particular have been characterized by steadily increasing bandwidths and ever expanding frequency limits. For example, early radar warning systems were typically designed to cover only limited sectors of the 2 to 10 GHz band, while present state-of-the-art systems commonly cover the entire range of from 2 to 18 GHz.

More recently, significant interest has been focused on further expanding the bandwidth capabilities of present day systems by providing coverage over an even lower range of the RF spectrum, and, in particular, over the 0.5 to 2 GHz range. One proposal to accomplish this envisions providing a supplementary antenna system to be added-on to existing systems. Such a supplementary system, however, is not particularly desirable because it would require an additional antenna array together with microwave components, higher cost, and increased aerodynamic drag. A much more desirable solution would be to provide a single antenna to cover the entire expanded frequency range. Furthermore, it is important that such an antenna system have substantially the same physical dimensions as standard cavity-backed spiral antennas typically used in airborne radar warning systems. This is important because favorable mounting locations on aircraft are difficult to find and antenna designers have been required to provide broad band performance within a closely defined volume.

SUMMARY OF THE PREFERRED EMBODIMENT

In accordance with the present invention, a novel circularly-polarized broad-beamed antenna system is provided which is capable of effectively covering the entire 0.5 to 18 GHz range without requiring additional antenna arrays. Furthermore, the system provided is approximately the same size as standard 2–18 GHz systems and adequately satisfies all of the generally standardized physical constraints and limitations placed upon airborne radar systems.

In accordance with a preferred embodiment of the invention, the antenna system comprises a generally conventional planar spiral antenna modified by having the outer ends of its arms terminated with a bifilar helix. The bifilar helix is placed with its axis at 90° to the spiral and lies behind it, and is designed to produce backfire circularly polarized radiation over a range from the normal low frequency cutoff of the planar spiral (2 GHz) down to about 0.5 GHz.

In operation of the helix loaded spiral antenna of the present invention, it has been found that within the standard 2–18 GHz range, the helix will not contribute to the radiation field and the planar spiral operates as if the helix were not present. Below about 1.5 GHz, the spiral ceases to be an effective radiator and functions as a transmission line feeding the helix, and the helix radiates essentially all of the energy supplied. In the 1.5 to 2 GHz band, operation is in transition between the two antenna elements, and both antenna portions radiate circularly polarized fields. However, by properly designing the interconnection between the spiral and the helix, pattern anomalies in that intermediate range can be substantially eliminated.

In general, the spiral-helix antenna according to the present invention provides a frequency coverage heretofore unattainable in a single device. It also provides quality performance over the entire frequency range and meets all of the rugged environmental conditions and dimensional limitations placed upon airborne systems. Further features and specific details of the antenna provided by the present invention will be set out hereinafter in conjunction with the detailed description of the preferred embodiments.

DETAILED DESCRIPTION OF THE PREFERRED EMBODIMENT

Figure 1:
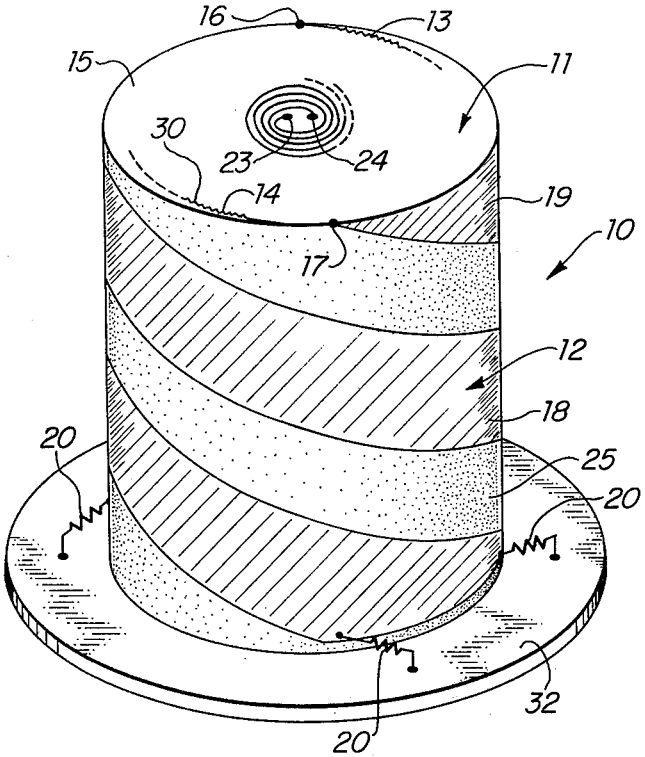
FIG. 1 illustrates a helix-loaded spiral antenna according to a presently most preferred embodiment of the invention.

FIG. 1 illustrates a helix-loaded spiral antenna according to a presently most preferred embodiment of the invention.

The antenna, designated by reference number 10, generally comprises a first planar spiral antenna portion 11 and a second helical antenna portion 12. The planar antenna portion 11 is of generally conventional type, for example, an equi-angular spiral or an Archimedean spiral, and comprises two spiral conductive arms 13 and 14 formed on a dielectric sheet 15.

The helical antenna portion 12 is directly coupled to the spiral arms 13 and 14, and is oriented with its axis perpendicular to the face of the planar spiral and is positioned behind it. Specifically, the helical antenna portion 12 comprises a bifilar helix having two helix arms 18 and 19 wound around a dielectric cylinder 25. The two helix arms are wound in the same direction as the spiral arms and are directly coupled to the outer ends 16 and 17 of the spiral arms 13 and 14, respectively. In the most preferred embodiment, helix arms 18 and 19 are constructed of approximately 1-inch wide copper foil wound at a pitch angle of about 45° with the spaces between the helix arms being approximately equal to the arm width (i.e., 1-inch). This configuration is preferrred because experiment has shown that loosely wrapped, self complimentary helices are more effective than tightly wrapped ones. It has also been found that using resistors having impedences of from about 50 to about 110 ohms to terminate the helix arms improves pattern characteristics at the low frequency limit. This is illustrated in FIG. 1 by resistors 20.

In addition, it has also been determined that by designing the ends of the spiral arms 13 and 14 to be irregular or meandering as illustrated schematically at 30 in FIG. 1, that pattern anomolies in the intermediate range of 1.5–2 GHz can be substantially eliminated.

Also shown in FIG. 1 is a base 32 for supporting the antenna. It conveniently may comprise the base for the outer can or cavity which will contain the antenna system (FIG. 2).

Figure 2:
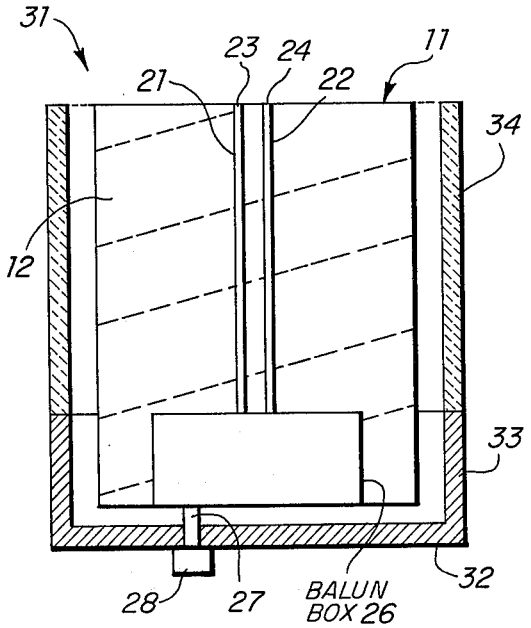
FIG. 2 illustrates the internal construction of the spiral-helix antenna of FIG. 1.

FIG. 2 illustrates the internal construction of the antenna system. The spiral arms 13 and 14 (not shown in FIG. 2) are fed by balanced lines 21 and 22, respectively, directly coupled to the inner ends or feed points 23 and 24 (FIG. 1) of the spiral arms. Balanced feed lines 21 and 22 are, in turn, connected through a balun box 26 (to be described in more detail hereinafter) to an unbalanced coaxial feed line 27 coupled to input 28 which, in turn, is coupled to energizing and utilization apparatus, now shown.

The antenna itself is 2½ inches in diameter and 2¾ inches in length which corresponds to the dimensions of standard cavity backed spiral antennas.

Also illustrated in FIG. 2 is the overall cavity or can which contains the antenna system. This can, identified by reference number 31 includes a base 32 to support the antenna and a cylindrical side-wall of convenient size. Because the helix itself will radiate, the cavity walls may be partly conducting and partly non-conducting. Preferably, base 32 and the bottom portion 33 of the side wall will be metallic such as aluminum, brass, etc., while the remainder of the side wall 34 will be of non-metallic material such as epoxy or fiberglass. Although not illustrated, various types and configurations of absorbing material may be placed inside the cavity to control undesired resonance. Also, metallic vane structures may be incorporated into the cavity to improve electrical characteristics.

As is generally known in the art, spiral antennas require a balanced feed of about 100 ohms impedence. If the feed is not balanced (180° apart in phase and equal amplitude), the radiation patterns of the spiral will have boresight shift and high axial ratios. Many precision spiral antennas have used coaxial baluns based on the designs by Marchand. These designs transform 50 ohm coax to 50 ohm balanced line. The balanced line connecting the balun to the spiral face is typically step-tapered to match the spiral face impedence of approximately 100 ohms.

Figure 3:
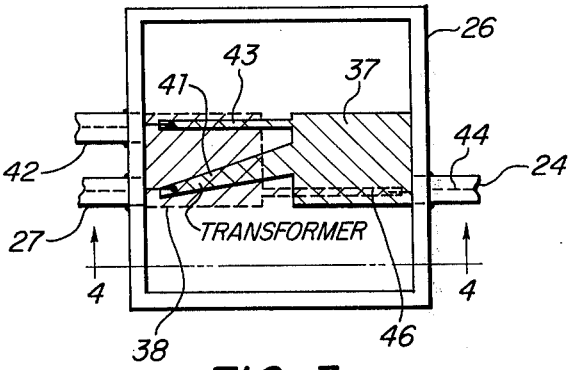
FIG. 3 illustrates a top view (with the cover removed) of a novel balun transformer preferred for use in the antenna of the present invention.
Figure 4:
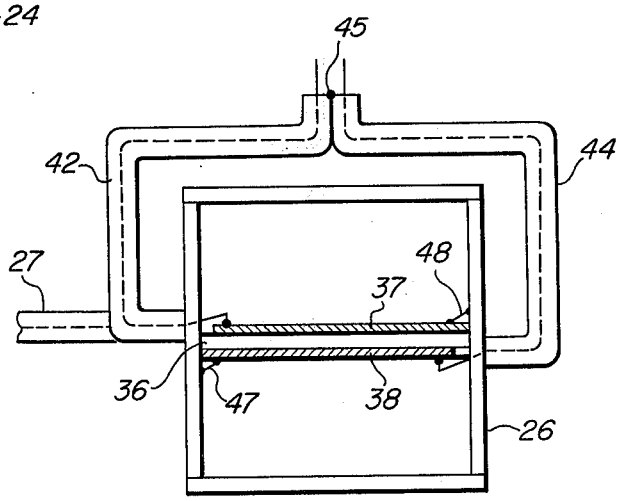
FIG. 4 is a cross-sectional view of the balun transformer of FIG. 3 looking in the direction of arrows 4—4 of FIG. 3.

Although such a balun could be used with this invention, the novel balun illustrated in FIGS. 3 and 4 is greatly preferred and provides several advantages, one of which is elimination of the machining needed to step-taper the balancing line. This novel balun does not form part of the present invention but is described briefly herein for completeness as the preferred transformer for use with the most preferred embodiment.

As illustrated in FIGS. 3 and 4, the balun comprises a 1-inch cube metallic balun box 26 supporting a printed circuit card 36 in a substantially horizontal position centrally therein. Specifically designed conductor elements 37 and 38 are printed on the top and bottom side, respectively, of the printed circuit card. They are designed to provide a symmetrical junction to the input line 27. The top conductor 37 is illustrated in solid line in FIG. 3 while the bottom conductor 38 is illustrated in dotted lines. The inner conductor of input coaxial cable 27 is coupled to the leg 41 of the upper conductor as illustrated while the outer conductor is connected to box 26. The inner conductor of the first output coaxial cable 42 is coupled to a second leg 43 of the upper conductor 37 while its outer conductor is coupled to box 26. The second output coaxial cable 44 has its inner conductor coupled to the leg 46 of the lower conductor 38 and its outer conductor also coupled to box 26. The two output cables 42 and 44 are the same length and have their outer conductors coupled together at point 45 while their inner conductors extend as balanced lines 21 and 22 to the inner ends 23 and 24 of the spirals to feed the antenna. The printed circuit card itself is also directly coupled to box 26 through connections 47 and 48.

The precise shapes of the two conductor elements 37 and 38 were selected to optimize the operation of the system. The manner of doing this is well-known to those in the art and need not be detailed here. It should be recognized that these elements may take other shapes as well.

The resulting new balun described above incorporates 4:1 impedence transformation. A balanced output impedence of 100 ohms is obtained since the impedences of the two output lines (each 50 ohms) are in series. The unbalanced input impedence of 25 ohms is the impedence of the two output lines in parallel at the internal junction point. However, the effective box impedence is also doubled since the two halves of the box appear in series.

By using this method of interconnection, this new balun design eliminates the undesirable 3-dimensional junction configuration found in a conventional Marchand balun.

Measured results on the balun transformer described above show good phase and amplitude balance from 0.4 to 18 GHz. Phase balance is within ±2.5° from 0.4 to 6 GHz and ±4° from 6 to 18 GHz. Amplitude balance is within ±0.3dB from 0.4 to 10 GHz and ±0.5dB from 10 to 18 GHz. VSWR is less than 2:1 over the entire frequency band. A 100 ohm load was used with the balun for these measurements.

Although what has been described above comprises the presently most preferred embodiment, it should be recognized that many modifications can be made without departing from the scope of the invention. For example, although an antenna system having two armed spirals and helices have been illustrated, other embodiments having four, six or eight arms are also possible. Also, although the helix is preferably constructed of 1-inch wide copper foil, other embodiments for example, copper wire, might also be employed.

Because many additions, omissions and changes can be made to the invention, it should be recognized that the invention should be limited only insofar as required by the scope of the following claims.

What is claimed is:

1. Antenna apparatus comprising:

a. a planar spiral antenna portion, said planar spiral antenna portion having spiral arm means having inner and outer ends;

b. a helical antenna portion coupled to the outer ends of said spiral arm means, said helical antenna portion being substantially coaxial with said planar spiral antenna portion; and, c. means coupled to the inner ends of said spiral arm means for energizing said antenna.

2. Apparatus as recited in claim 1 wherein said helical antenna portion comprises helical arm means constructed of conductive foil wound such that the spaces between the windings of said arm means are approximately equal to the width of said arm means.

3. Apparatus as recited in claim 2 wherein the width of said helical arm means is approximately 1-inch.

4. Apparatus as recited in claim 3 wherein said conductive foil comprises copper foil.

5. Apparatus as recited in claim 3 wherein the ends of said helical arm means opposite the ends thereof coupled to said spiral arm means are terminated by resistor means having an impedence of from about 50 to about 110 ohms to improve the pattern characteristics of said antenna.

6. Antenna apparatus comprising:

a. a planar spiral antenna portion, said planar spiral antenna portion having first and second spiral arm means having inner and outer ends;

b. a helical antenna portion, said helical antenna portion comprising a bifilar helix having first and second helix arms coupled to the outer ends of said first and second spiral arm means, respectively, said helical antenna portion having its axis substantially perpendicular to the plane of said planar spiral antenna portion; and, c. means coupled to the inner ends of said spiral arm means for energizing said antenna.

7. Apparatus as recited in claim 6 wherein said first and second helix arms are constructed of approximately 1-inch wide copper foil.

8. Apparatus as recited in claim 7 wherein the spacing between the windings of said first and second helix arms are approximately equal to the width of said helix arms.

9. Apparatus as recited in claim 8 wherein the ends of each of said first and second helix arms opposite the ends thereof coupled to said first and second spiral arms are terminated by resistor means having impedences of from about 50 to about 110 ohms to improve the pattern characteristics of said antenna.

10. A circularly polarized, broad-beamed antenna system having an expanded bandwidth coverage of from about 0.5 GHz to about 18 GHz comprising:

a. a planar spiral antenna portion having a pair of spiral arms having inner and outer ends;

b. a helical antenna portion having a pair of helical arms connected directly to the outer ends of said spiral arms, said helical antenna portion being positioned behind said planar spiral antenna portion and being substantially coaxial with said planar spiral antenna portion; and, c. means coupled to the inner ends of said pair of spiral arms for energizing said antenna.

11. Apparatus as recited in claim 10 wherein said helix arms comprise approximately 1-inch wide copper foil.

12. Apparatus as recited in claim 11 wherein the spacing between the windings of said helix arms is approximately equal to the width of said helix arms.

* * * * *